US008368621B2

(12) United States Patent
Takasugi

(10) Patent No.: US 8,368,621 B2
(45) Date of Patent: Feb. 5, 2013

(54) IMAGE DISPLAY DEVICE

(75) Inventor: Shinji Takasugi, Kanagawa (JP)

(73) Assignee: LG Display Co., Ltd., Seoul (KR)

( * ) Notice: Subject to any disclaimer, the term of this patent is extended or adjusted under 35 U.S.C. 154(b) by 691 days.

(21) Appl. No.: 12/436,904

(22) Filed: May 7, 2009

(65) Prior Publication Data

US 2009/0213148 A1 Aug. 27, 2009

Related U.S. Application Data

(63) Continuation of application No. 12/085,658, filed as application No. PCT/JP2006/321574 on Oct. 27, 2006, now abandoned.

(30) Foreign Application Priority Data

Nov. 29, 2005 (JP) ..... 2005-344080

(51) Int. Cl.
*G09G 3/30* (2006.01)

(52) U.S. Cl. ..... 345/77; 315/169.3

(58) Field of Classification Search ..... 313/463; 315/169.3; 345/76–83
See application file for complete search history.

(56) References Cited

U.S. PATENT DOCUMENTS

| | | | | |
|---|---|---|---|---|
| 5,621,439 | A | 4/1997 | Okada et al. | |
| 5,905,387 | A * | 5/1999 | Chinosi et al. | 327/62 |
| 6,963,335 | B2 | 11/2005 | Tanaka et al. | |
| 7,170,232 | B2 * | 1/2007 | Miwa et al. | 315/169.3 |
| 2002/0154084 | A1 * | 10/2002 | Tanaka et al. | 345/92 |
| 2004/0100203 | A1 | 5/2004 | Kobayashi et al. | |
| 2006/0044237 | A1 | 3/2006 | Lee et al. | |
| 2006/0107143 | A1 | 5/2006 | Kim et al. | |
| 2006/0108937 | A1 | 5/2006 | Kim | |

FOREIGN PATENT DOCUMENTS

| | | | |
|---|---|---|---|
| CN | 1383497 | A | 12/2002 |
| JP | 7-72833 | A | 3/1995 |
| JP | 2002-189437 | A | 7/2002 |
| JP | 2003-280590 | A | 10/2003 |
| JP | 2004-170815 | A | 6/2004 |
| JP | 2006-65281 | A | 3/2006 |
| JP | 2006-113548 | A | 4/2006 |
| JP | 2006-133745 | A | 5/2006 |

OTHER PUBLICATIONS

R.M.A. Dawson, et al. (1998), Design of an Improved Pixel for a Polysilicon Active—Matrix Organic LED Display, SID 98 Digest, pp. 11-14.

S. Ono, et al. (2003), Pixel Circuit for a—Si AM-OLED, Proceedings of IDW '03, pp. 255-258.

* cited by examiner

*Primary Examiner* — Amr Awad
*Assistant Examiner* — Aaron Midkiff
(74) *Attorney, Agent, or Firm* — Birch, Stewart, Kolasch & Birch, LLP

(57) ABSTRACT

An image display device includes a plurality of pixels, and feeders that commonly supply power to the plurality of pixels. In this image display device, each of the pixels has a light-emitting portion that emits light by a current supplied to the light-emitting portion, a driver that controls light emission of the light-emitting portion, and a switching portion electrically connected to the driver. The parasitic capacitance of the switching portion is determined with respect to each one pixel or one group of pixels according to the voltage drop of said feeder.

11 Claims, 6 Drawing Sheets

IMAGE DISPLAY DEVICE

This application is a Continuation of application Ser. No. 12/085,658, filed on Dec. 1, 2008 now abandoned, and for which priority is claimed under 35 USC §120. application Ser. No. 12/085,658 is the national phase of PCT/JP2006/321574 filed on Oct. 27, 2006 under 35 USC §371, which claims priority of JP2005-344080 filed Nov. 29, 2005. The entire contents of each of the above-identified applications are hereby incorporated by reference.

BACKGROUND OF THE INVENTION

1. Field of the Invention

The present invention relates to image display devices such as organic electroluminescent (EL) display devices.

2. Description of the Background Art

There have been proposed image display devices using organic EL elements that have a function of emitting light as a result of recombination of holes and electrons injected into an emissive layer.

In this type of image display device, a thin film transistor (hereinafter referred to as a "TFT") formed of, e.g., amorphous silicon or polycrystalline silicon, and an organic light-emitting diode (hereinafter referred to as an "OLED"); which is one of organic EL elements, constitutes each pixel, and pixels are arranged in a matrix. By setting an appropriate electric current for each pixel, the luminance of each pixel is controlled, so that a desired image is displayed.

In this respect, refer to R. M. A. Dawson, et al. (1998), Design of an Improved Pixel for a Polysilicon Active-Matrix Organic LED Display, SID 98 Digest, pp. 11-14, and S. Ono, et al. (2003), Pixel Circuit for a-Si AM-OLED, Proceedings of IDW '03, pp. 255-258.

In an image display device as described above, a plurality of pixels share feeders. The feeders have a gradual voltage drop, which causes an applied voltage to each pixel to vary depending on the voltage drop, and luminance non-uniformity may occur in a displayed image. For example, in a feeding system of supplying a predetermined voltage from the lower side to pixels arranged in a matrix, an applied voltage to an organic EL device in a pixel located on the upper side is lower than that in a pixel located on the lower side. Thus, luminance non-uniformity is recognized in which luminance gradually decreases as the distance of a pixel and the feeder lines increases.

Note that it is possible to make equal the length or resistance of feeders to each pixel so that all pixels have the same voltage drop, but such methods should be avoided because they limit the design flexibility and increase the manufacturing costs.

SUMMARY OF THE INVENTION

This invention is directed to an image display device.

According to an aspect of this invention, this image display device includes a plurality of pixels, and feeders that commonly supply power to the plurality of pixels. In this image display device, each of the pixels has a light-emitting portion that emits light by a current supplied to the light-emitting portion, a driver that controls light emission of the light-emitting portion, and a switching portion electrically connected to the driver, wherein a parasitic capacitance of the switching portion of each pixel is determined with respect to each one pixel or one group of pixels according to the amount of the voltage drop of the feeders.

With this, the effect of the voltage drop of the feeders can be reduced to reduce the luminance non-uniformity on the image display device.

Also, according to another aspect of this invention, this image display device includes a plurality of pixels, and feeders that commonly supply power to the plurality of pixels. In this image display device, each of the pixels has a light-emitting portion that emits light by a current supplied to the light-emitting portion, a driver that controls light emission of the light-emitting portion, and a capacitor electrically connected to the driver, wherein a capacitance of said capacitor of each pixel is determined with respect to each one pixel or one group of pixels according to the amount of the voltage drop of the feeders.

With this, the effect of the voltage drop of the feeders can be reduced to reduce the luminance non-uniformity on the image display device.

Also, according to still another aspect of this invention, this image display device includes a plurality of pixels, feeders that commonly supply power to the plurality of pixels, a plurality of control lines electrically connected to the pixels, wherein the voltage of each of the control lines is determined according to the amount of the voltage drop of the feeders. In this image display device, each of the pixels has a light-emitting portion that emits light by a current supplied to the light-emitting portion, a driver that controls light emission of the light-emitting portion, and a switching portion electrically connected to the control line.

With this, the effect of the voltage drop of the feeders can be reduced to reduce the luminance non-uniformity on the image display device.

Also, according to yet another aspect of this invention, this image display device includes a plurality of pixels, feeders that commonly supply power to the plurality of pixels, and a plurality of control lines electrically connected to the pixels. In this image display device, each of the pixels has a light-emitting portion that emits light by a current supplied to the light-emitting portion; a driver that has a first terminal, a second terminal, and a third terminal, said first terminal controlling the current flowing between said second terminal and said third terminal, which current controls light emission of the light-emitting portion; and a switching portion that has a fourth terminal, fifth terminal, and sixth terminal, said fourth terminal controlling the current flowing between said fifth terminal and said sixth terminal, and that is electrically connected to the control line; and an additional capacitor electrically connected to said first terminal; wherein the second terminal is electrically connected to the light-emitting portion during the light emission period, said fifth terminal is electrically connected to said second terminal, said sixth terminal is electrically connected to said first terminal, and a capacitance of said additional capacitor is determined according to the amount of voltage drop of the feeders.

With this, the effect of the voltage drop of the feeders can be reduced to reduce the luminance non-uniformity on the image display device.

Consequently, it is an object of this invention to provide an image display device that can perform luminance compensation for suppressing the effect of luminance non-uniformity due to the voltage drop of the feeders.

These and other objects, features, aspects and advantages of the present invention will become more apparent from the following detailed description of the present invention when taken in conjunction with the accompanying drawings.

DESCRIPTION OF THE PREFERRED EMBODIMENTS

Embodiments according to an image display device of the invention will be described in detail below with reference to the drawings. It should be noted that the invention is not limited to these embodiments.

Figure 1:
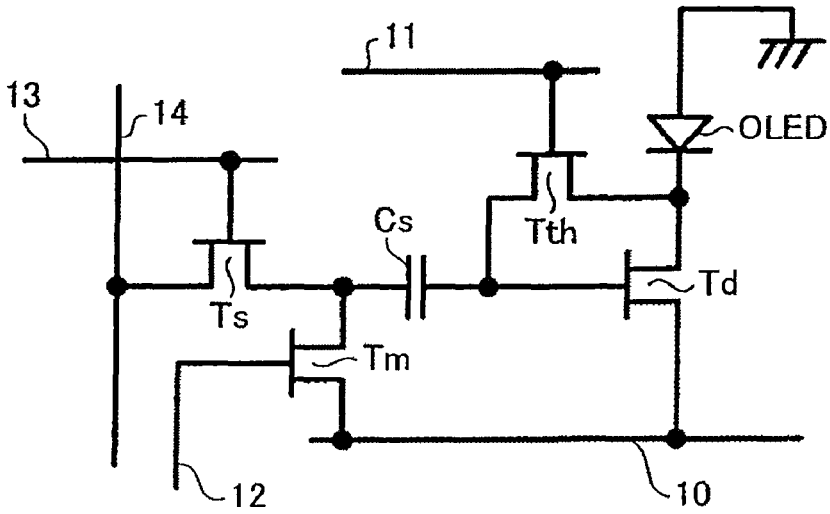
FIG. 1 is a diagram for illustrating one embodiment of an image display device according to the invention, and shows a configuration example of a pixel circuit corresponding to one pixel in a display portion of an image display device.

FIG. 1 is a diagram for illustrating one embodiment of an image display device according to the invention, and shows a configuration example of a pixel circuit corresponding to one pixel in a display portion of an image display device. That is, an image display device has a configuration where a plurality of pixel circuits as shown in FIG. 1 is arranged in a matrix.

A pixel circuit shown in FIG. 1 has a configuration including an organic light-emitting element OLED being one of light-emitting portions, a driving transistor Td being a driver for driving the organic light-emitting element OLED, a threshold voltage detection transistor Tth for detecting a threshold voltage of the driving transistor Td, a storage capacitor Cs for holding a data voltage (Vdata), a switching transistor Ts and a switching transistor Tm.

The driving transistor Td includes a gate being a control terminal, a drain being a first terminal, and a source being a second terminal, and is a control element (a driving element) for controlling an amount of electric current flowing through an organic light-emitting element OLED depending on a voltage difference provided between the gate and the source.

When turned on, the threshold voltage detection transistor Tth electrically connects the gate and the drain of the driving transistor Td. As a result, a current flows from the gate toward the drain of the driving transistor Td until a gate-to-source voltage of the driving transistor Td becomes substantially equal to the threshold voltage Vth of the driving transistor Td, so that the threshold voltage Vth of the driving transistor Td is detected.

The organic light-emitting element OLED has a structure including at least an anode layer and a cathode layer formed of a conductive material such as Al, Cu or indium tin oxide (ITO) etc., and an emissive layer formed of an organic material such as phthalocyanine, a trisaluminum complex, benzoquinolinolato or a beryllium complex between the anode layer and the cathode layer. When a voltage difference greater than or equal to a threshold voltage of the organic light-emitting element OLED is applied between both ends of the organic light-emitting element OLED, holes and electrons are injected into the emissive layer, and light is emitted from the emissive layer because of the electron-hole recombination.

The driving transistor Td, the threshold voltage detection transistor Tth the switching transistor Ts and the switching transistor Tm are constituted as, e.g., a TFT. Note that in the drawings referred to hereinafter, while channels (n-type or p-type) of TFTs are not specified, either of n-type and p-type may be used. In the present embodiment, all the TF's are of n-type as described above. Each TFT may be formed using any of amorphous silicon, microcrystalline silicon and polycrystalline silicon.

A power supply line 10 supplies a predetermined power supply voltage to the driving transistor Td and the switching transistor Tm. A Tth control line 11 supplies a signal for controlling the driving of the threshold voltage detection transistor Tth to the threshold voltage detection transistor Tth. A merge line 12 supplies a signal for controlling the driving of the switching transistor Tm to the switching transistor Tm. A scan control line 13 supplies a signal for controlling driving of the switching transistor Ts to the switching transistor Ts. An image signal line 14 supplies an image signal to the storage capacitor Cs. Note that the power supply line 10, the Tth control line 11, the merge line 12 and the scan control line 13 are commonly connected to each pixel circuit arranged in a row direction. The image signal line 14 is commonly connected to each pixel circuit arranged in a column direction.

Note that a ground line is electrically connected to the anode side of the organic light-emitting element OLED, and the power supply line 10 to the cathode side of the organic light-emitting element OLED, for supplying a predetermined voltage in FIG. 1. However, the power supply line 10 may be connected to the anode side of the organic light-emitting element OLED, and the ground line may be connected to the cathode side of the organic light-emitting OLED. Alternately, the power supply line may be connected to both the anode and cathode sides of the organic light emitting element OLED. Both the power supply line 10 and the ground line are hereinafter referred to as feeders.

Figure 2:
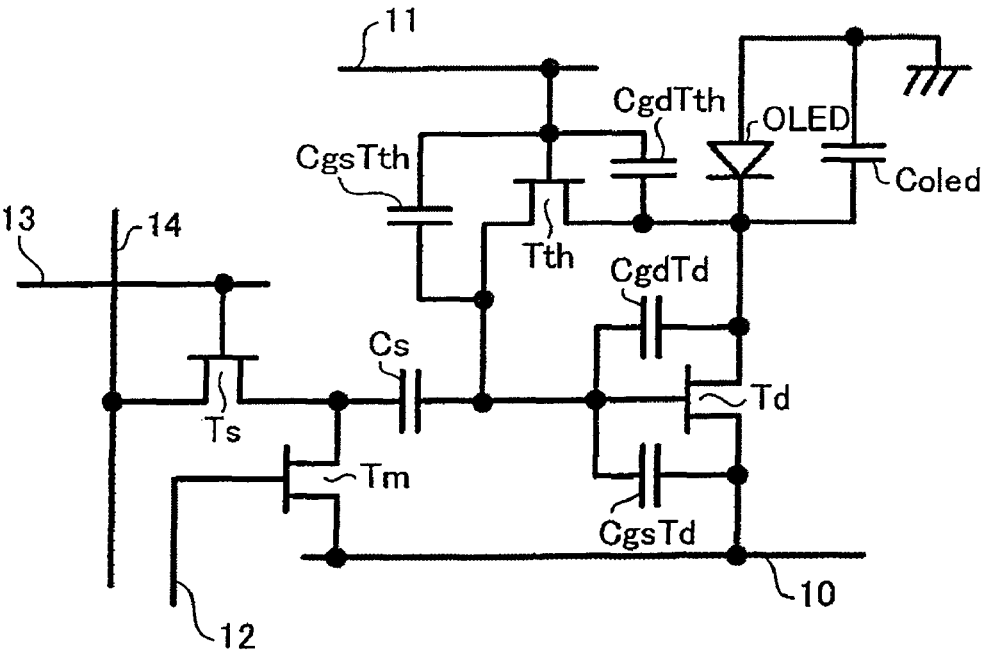
FIG. 2 shows a circuit configuration in which the parasitic capacitances of the transistors and the OLED capacitance are shown on the pixel circuit shown in FIG. 1.

Each TFT has parasitic capacitances between the gate and the source and between the gate and the drain. Among them, a gate-source capacitance CgsTd and a gate-drain capacitance CgdTd of the driving transistor Td, and the gate-source capacitance CgsTth and a gate-drain capacitance CgdTth of the threshold voltage detection transistor Tth mainly affect the gate voltage of the driving transistor Td in the embodiment. FIG. 2 shows, in addition to FIG. 1, the parasitic capacitances and the OLED capacitance Coled, which inherently included in the organic light-emitting element OLED.

Figure 3:
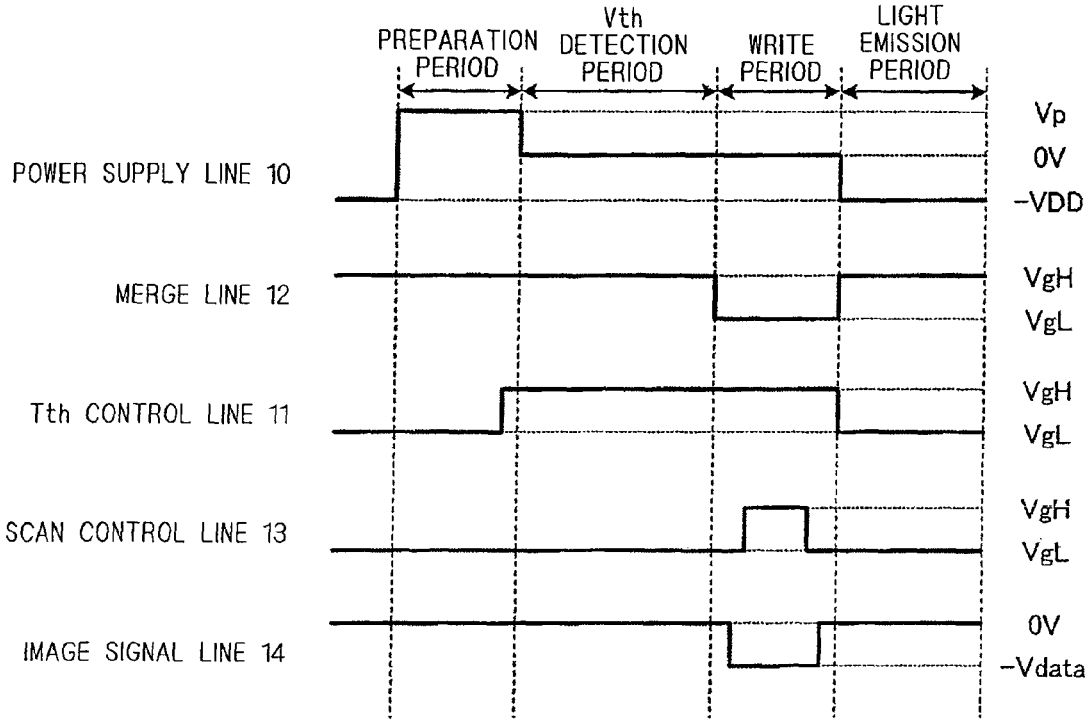
FIG. 3 is a sequence diagram for illustrating general operations of the pixel circuit shown in FIG. 2.
Figure 5:
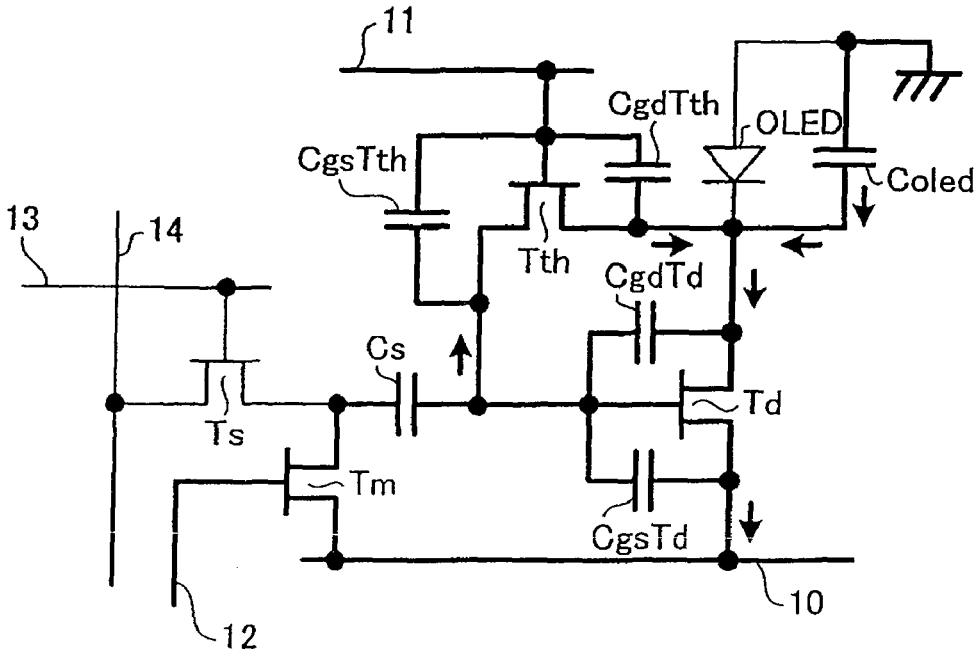
FIG. 5 is a diagram for illustrating operations during the threshold voltage detection period shown in FIG. 3.
Figure 6:
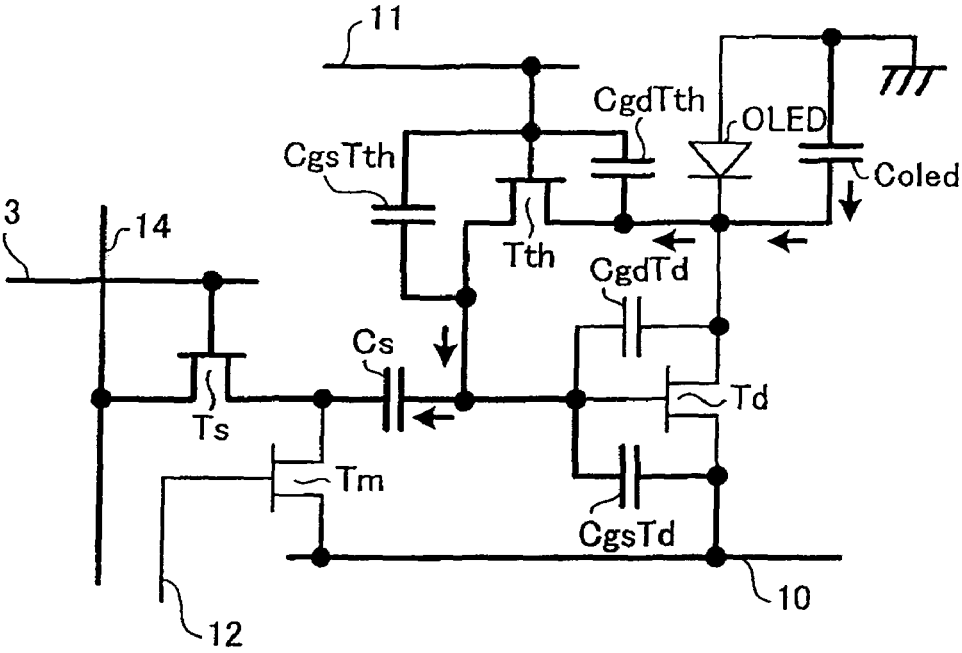
FIG. 6 is a diagram for illustrating operations during the writing period shown in FIG. 3.
Figure 7:
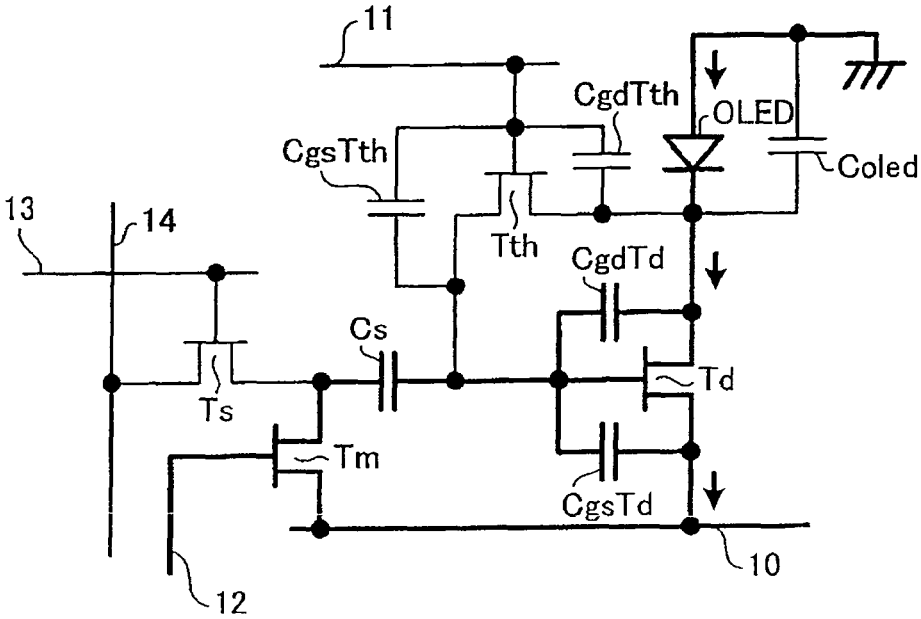
FIG. 7 is a diagram for illustrating operations during the light emission period shown in FIG. 3.

With reference to FIGS. 3 to 7, operations of the embodiment are described below. Here, FIG. 3 is a sequence diagram for illustrating general operations of the pixel circuit shown in FIG. 2. FIGS. 4 to 7 are diagrams for each illustrating operations during each of four periods: the preparation period (FIG. 4), the threshold voltage detection period (FIG. 5), the writing 15 period (FIG. 6) and the light emission period (FIG. 7). Note that operations described below are performed under control of a controller (not shown).

(Preparation Period)

Figure 4:
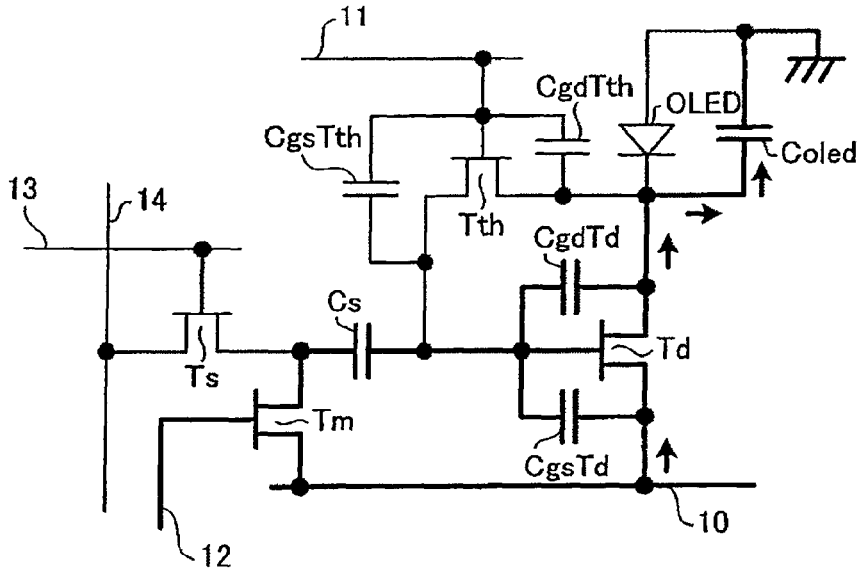
FIG. 4 is a diagram for illustrating operations during the preparation period shown in FIG. 3.

With reference to FIGS. 3 and 4, operations during the preparation period are described. During the preparation period, the power supply line 10 is at a high voltage (Vp), the merge line 12 is at a high voltage (VgH), the Tth control line 11 is at a low voltage (VgL), the scan control line 13 is at the low voltage (VgL), and the image signal line 14 is at zero volt. Thus, as shown in FIG. 4, the threshold voltage detection transistor Tth is in the off-state, the switching transistor Ts is in the off-state, the driving transistor 25 Td is in the on-state, and the switching transistor Tm is in the on-state, and a current flows from the power supply line 10 through the driving transistor Td to the OLED capacitance Coled, so that an electric charge is accumulated in the OLED capacitance Coled. Note that the reason for accumulating an electric charge in the OLED capacitance Coled during the preparation period is to cause the OLED capacitance Coled to act as a supply source of a current (Ids) flowing between the drain and the source of the driving transistor Td in detecting the threshold voltage Vth of the driving transistor Td during the threshold voltage detection period to be described later.

(Threshold Voltage Detection Period)

Next, with reference to FIGS. 3 and 5, operations during the threshold voltage detection period are described. During the threshold voltage detection period, the power supply line 10 is at zero volt, the merge line 12 is at the high voltage (VgH), the Tth control line 11 is at the high voltage (VgH), the scan control line 13 is at the low voltage (VgL), and the image signal line 14 is at zero volt. Thus, as shown in FIG. 5, the threshold voltage detection transistor Tth is turned on, and thus the gate and the drain of the driving transistor Td are connected.

Electric charges accumulated in the storage capacitor Cs and the OLED capacitance Coled are discharged, and a current flows through the driving transistor Td to the power supply line 10. When the gate-to-source voltage of the driving transistor Td reaches the threshold voltage Vth, the driving transistor Td is substantially in the off-state, and thus the threshold voltage Vth of the driving transistor Td is detected.

(Writing Period)

Further, with reference to FIGS. 3 and 6, operations during the writing period are described. During the writing period, by supplying a data voltage (−Vdata) to the storage capacitor Cs, the gate voltage of the driving transistor Td is changed to a desired voltage depending on the data voltage. Specifically, the power supply line 10 is at zero volt, the merge line 12 is at the low voltage (VgL), the Tth control line 11 is at the high voltage (VgH), the scan control line 13 is at the high voltage (VgH), and the image signal line 14 is at the data voltage (−Vdata).

Thus, as shown in FIG. 6, the switching transistor Ts is in the on-state and the switching transistor Tm is in the off-state. The electric charge accumulated in the OLED capacitance Coled is discharged. A current flows from the OLED capacitance Coled through the threshold voltage detection transistor Tth to the storage capacitor Cs. Thus, an electric charge is accumulated in the storage capacitor Cs. In other words, a part of the electric charge accumulated in the OLED capacitance Coled is moved into the storage capacitor Cs. As a result, the gate voltage of the driving transistor Td becomes a voltage corresponding to the data voltage. Note that it is preferable that a period during which the image signal line 14 is at the data voltage (−Vdata) is longer than that during which the scan control line 13 is at the high voltage (VgH), which corresponds to scan signals. The reason for this is that it takes some time for the gate voltage of the driving transistor Td to actually become a voltage corresponding to the data voltage (−Vdata) supplied from the image signal line 14 after the scan control line 13 is set at the high voltage.

Here, assuming that the threshold voltage of the driving transistor 25 Td is Vth, the capacitance of the storage capacitor Cs is Cs, the total capacitance when the threshold voltage detection transistor Tth is in the on-state (that is, the electrostatic capacitance and the parasitic capacitance connected to the gate of the driving transistor Td) is Call, a gate voltage Vg of the driving transistor Td can be expressed by the following equation (note that the above assumption is also applied to equations and expressions given below).

$$Vg=Vth-(Cs/\mathrm{Call})\cdot V\mathrm{data} \quad (1)$$

A voltage difference VCs between one and another ends of the storage capacitor Cs is expressed by the following equation.

$$VCs=Vg-(-V\mathrm{data})=Vth+[(\mathrm{Call}-Cs)/\mathrm{Call}]V\mathrm{data} \quad (2)$$

The total capacitance Call shown in the above equation (2), which is a total capacitance during the threshold voltage detection transistor Tth being in the on-state, is expressed by the following equation.

$$\mathrm{Call}=\mathrm{Coled}+Cs+CgsTth+CgdTth+CgsTd \quad (3)$$

Note that the reason why the gate-drain capacitance CgdTd of the driving transistor Td is not included in the above equation (3) is that the gate and the drain of the driving transistor Td are electrically connected by the threshold voltage detection transistor Tth, so that the gate and the drain of the driving transistor Td have approximately the same voltage. The storage capacitor Cs and the OLED capacitance Coled generally satisfy a relationship of Cs<Coled.

(Light Emission Period)

Finally, with reference to FIGS. 3 and 7, operations during the light emission period are described. During the light emission period, the power 25 supply line 10 is at a negative voltage (−VDD), the merge line 12 is at the high voltage (VgH), the Tth control line 11 is at the low voltage (VgL), the scan control line 13 is at the low voltage (VgL), and the image signal line 14 is at zero volt.

Thus, as shown in FIG. 7, the driving transistor Td is in the on-state, the threshold voltage detection transistor Tth is in the off-state, and the switching transistor Ts is in the off-state. A current flows from the organic light-emitting element OLED through the driving transistor Td to the power supply line 10. Thus, organic light-emitting element OLED emits light.

At this point, a current (that is, Ids) flowing from the drain to the source of the driving transistor Td is determined from a configuration and a material of the driving transistor Td. Using a constant (3 proportional to the mobility of carriers of the driving transistor Td, the gate-to-source voltage Vgs of the driving transistor Td and the threshold voltage Vth of the driving transistor Td, the current is expressed by the following equation.

$$Ids=(\beta/2)\cdot(Vgs-Vth)^2 \quad (4)$$

Next, in order to consider a relationship between the gate-to-source voltage Vgs of the driving transistor Td and the current Ids, a voltage difference Vgs of the pixel circuit without consideration of the parasitic capacitance is calculated.

In FIG. 7, the driving transistor Td is in the on-state when light is emitted. Since electric charges corresponding to the write voltage (−Vdata) are distributed between the storage capacitor Cs and the OLED capacitance Coled depending on their capacitances, the gate voltage Vgs of the driving transistor Td can be expressed by the following equation.

$$Vgs=Vth+\mathrm{Coled}/(Cs+\mathrm{Coled})\cdot V\mathrm{data} \quad (5)$$

Accordingly, a relational expression of the gate-to-source voltage Vgs of the driving transistor Td and the current Ids is as follows by using the above equations (4) and (5).

$$Ids=(\beta/2)\cdot(\mathrm{Coled}/(Cs+\mathrm{Coled})\cdot V\mathrm{data})^2=a\cdot V\mathrm{data}^2 \quad (6)$$

As shown in the equation (6), the current Ids that is not dependent on the threshold voltage Vth can be theoretically obtained. Note that the luminance of the organic light-emitting element OLED is proportional to a current flowing through the organic light-emitting element OLED, and therefore the luminance that is substantially not dependent on the threshold voltage Vth can be obtained.

Thus, the foregoing pixel circuit compensates for changes of the threshold voltage of the driving transistor Td and the effects of the parasitic capacitances of the transistors including the driving transistor Td.

Figure 8:
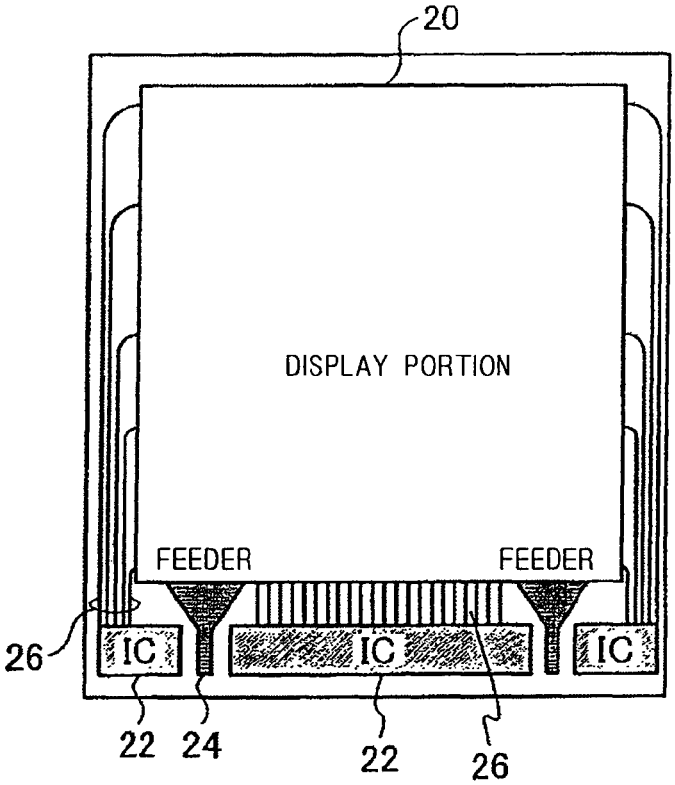
FIG. 8 shows a display portion and an area other than the display portion of the image display device.

FIG. 8 shows a display portion having the foregoing pixel circuit and an area other than the display portion of the image display device. The image display device shown in FIG. 8 approximately includes, on a substrate, a display portion 20, feeders 24 for supplying power to each pixel circuit constituting the display portion 20; a drive IC 22 for controlling supply of signals to the Tth control line 11, the scan control line 13, the image signal line 14 and the like connected to each pixel circuit; and drive signal lines 26 such as the Tth control line 11, the scan control line 13 and the image signal line 14. Note that the feeders 24 are disposed along the vertical direction from the outside of the display portion 20 to the inside of the display portion 20. One end of the feeders 24 is electrically connected to the power supply line 10 of each pixel circuit disposed in a direction approximately orthogonal to the feeders 24 in a region of the display portion 20. The other end of the feeder 24 is electrically connected via an electrode pad (not shown) to an output terminal of the power supply voltage.

In a feeding system as shown in FIG. 8, a voltage drop occurring on the feeders vary depending on the length of the wire of the feeders to a pixel. Accordingly, voltage supplied to a pixel circuit tends to be lower in a pixel circuit located at the upper side than in a pixel circuit located at the lower side. Therefore, there is a possibility of luminance non-uniformity, in which the luminance gradually decreases from the lower to the upper sides, is visually recognized.

In the embodiment, values of predetermined circuit elements in a pixel circuit and the control voltage for the predetermined circuit elements are made different from one pixel to another to suppress luminance non-uniformity as mentioned above. Description on compensation methods for this is given below.

(First Compensation Method—Method of Adjusting Gate-Source Capacitance CgsTth of Threshold Voltage Detection Transistor Tth)

In the image display device in FIGS. 7 and 8, a current flowing through the organic light-emitting element OLED of each pixel during light emission is supplied through the feeders 24 connected to the power supply line 10 and the ground line. Due to the resistance that the feeders have, depending on the distance from an arbitrary reference point (e.g., the other end of the feeder 24, hereinafter referred to as a "input center") to a pixel circuit of each pixel, the voltage on a side of a high voltage feeder (the ground line in an example in FIG. 7) drops and/or the voltage of low voltage feeder (the power supply line 10 in FIG. 7) increases, and thus the voltage applied to both ends of the organic light-emitting element OLED drops. Capacitance factors electrically connected to the gate of the driving transistor Td during the light emission period are the storage capacitor Cs, the gate-drain capacitance CgdTd of the driving transistor Td, the gate-source capacitance CgsTd of the driving transistor Td, and the gate-source capacitance CgsTth of the threshold voltage detection transistor Tth.

Here, assuming that an amount of voltage drop of the ground line is x, an amount of voltage drop ΔVgs of the gate-to-source voltage Vgs of the driving transistor Td in the amount of voltage drop x can be expressed by the following equation.

$$\Delta gs = x \cdot CgdTd/(Cs+CgdTd+CgsTd+CgsTth) \quad (7)$$

On the other hand, assuming that an amount of voltage increase of the power supply line 10 is y, the amount of voltage drop ΔVgs of the gate-to-source voltage Vgs of the driving transistor Td in the amount of voltage increase y can be expressed by the following equation, like the equation (7).

$$\Delta Vgs = y \cdot (CgdTd+CgsTth)/(Cs+CgdTd+CgsTd+CgsTth) \quad (8)$$

ΔVgs given in the equations (7) and (8) represents the amount of voltage drop of the gate-to-source voltage Vgs that occurs depending on the distance from the input center. Therefore, applying a compensation voltage to the driving transistor Td to compensate for the amount of voltage ΔVgs enables suppression of luminance non-uniformity that is visually recognized on an image display device.

The gate-to-source voltage Vgs applied to a pixel circuit nearest to the input center is the most resistant to being affected by a voltage drop component of a feeder. Accordingly, in this case, a compensation voltage to be applied to the driving transistor Td may be the smallest as compared to other pixel circuits. Assuming that the gate-to-source voltage Vgs applied to the pixel circuit nearest to the input center is Vgsmin, the gate-to-source voltage Vgs applied to the driving transistor Td of each pixel circuit can be expressed by the following equation by using the amount of voltage drop ΔVgs given in the above equations (7) and/or (8).

$$Vgs = Vgs\min + \Delta Vgs \quad (9)$$

The equation (9) means that based on the current and the resistance of a feeder that provide the maximum luminance to a pixel nearest to the input center, it is possible to calculate a voltage difference (Vgs) between the gate and the source required to cause each pixel to emit light at the highest luminance without being affected by the voltage drop of the feeder. Note that the value of ΔVgs given by the equation (9) increases with an increase of the distance from the input center. The value of Vgs in the left-hand side of the equation needs to be increased in accordance with an increase of the value of ΔVgs.

Next, controlling of ΔVgs given in the equation (9) is described. Adjusting the amount of the gate-source capacitance CgsTth of the threshold voltage detection transistor Tth in each pixel is first considered. Now assuming that the gate-source capacitance CgsTth of the threshold voltage detection transistor Tth in a pixel nearest to the input center is CgsTthmax, and the variation in CgsTth determined based on ΔVgs of the equation (9) is ΔCgsTth, the gate-source capacitance CgsTth of the threshold voltage detection transistor Tth set for each pixel can be expressed by the following equation by using these CgsTthmax and ΔCgsTth.

$$Cgsth = CgsTth\max - \Delta CgsTth \quad (10)$$

On the other hand, after completion of the writing period, the Tth control line 11 controlling the threshold voltage detection transistor Tth is changed from the high voltage (VgH) to the low voltage (VgL) (refer to FIG. 3), and therefore the variation in a voltage applied to the driving transistor Td is given by the following expression.

$$-(VgH-VgL)\cdot(CgdTth+CgsTthmax-\Delta CgsTth)/(Cs+CgdTd+CgsTd+CgsTthmax-\Delta CgsTth) \quad (11)$$

A relationship of ΔCgsTth<<Cs generally holds in the foregoing pixel circuit, and therefore the above expression (11) can be simplified as follows.

$$-(VgH-VgL)\cdot(CgdTth+CgsTthmax-\Delta CgsTth)/(Cs+CgdTd+CgsTd+CgsTthmax) \quad (12)$$

Note that the component of the first term of the right side in the equation (9) corresponds to the term "CgdTth+CgsThmax" in the expression (12), and the component of the second term of the right side in the equation (9) corresponds to the term "ACgsTth" in the expression (12).

Accordingly, using these relationships and the component of ΔVgs based on the equations (7) and (8), the component of the second term of the equation (9) can be expressed as follows.

$$\Delta Vgs=[-x\cdot CgdTd-y\cdot(CgdTd+CgsTth\max)+(VgH-VgL)\cdot\Delta CgsTth)]/(Cs+CgdTd+CgsTd+CgsTth\max) \quad (13)$$

When ΔCgsTth is calculated such that ΔVgs=0 in the above equation (13), ΔCgsTth can be expressed by the following equation.

$$\Delta CgsTth=[x\cdot CgdTd+y\cdot(CgdTd+CgsTth\max)]/(VgH-VgL) \quad (14)$$

Accordingly, if the threshold voltage detection transistor Tth having a CgsTth component satisfying the equation (14) is designed, the variation of the gate-to-source voltage Vgs of the driving transistor Td in each pixel theoretically have the greatest reduction, thereby obtaining approximately uniform luminance over the entire display screen. Note that in actuality, if based on the equation (14), design is made such that the parasitic capacitance component CgsTth of the threshold voltage detection transistor Tth decreases as the amount of voltage drop of the feeders in each pixel increases, thereby reducing the variation of the gate-to-source voltage Vgs of the driving transistor Td in each pixel. This results in obtaining approximately uniform luminance over the entire display screen. Note that the values of the parasitic capacitance components CgsTth may differ from one pixel to another. However, from the viewpoint of productivity, it is preferable that a plurality of pixels arranged in a matrix is divided into groups by row and the values of the parasitic capacitance components CgsTth differ from one group to another group.

In the embodiment, the driving transistor Td and the threshold voltage detection transistor Tth are transistors of the same n-type. Because both transistors are ones of the same conductive type, setting is made such that the parasitic capacitance component CgsTth of the threshold voltage detection transistor Tth in each pixel decreases as the amount of voltage drop of the feeders increases. The same is true when the driving transistor Td and the threshold voltage detection transistor Tth are p-type transistors. On the other hand, when the driving transistor Td and the threshold voltage detection transistor Tth are different conductive types of transistors (e.g., the driving transistor Td is of n-type and the threshold voltage detection transistor Tth is of p-type, or vise-versa), setting is made such that the parasitic capacitance component CgsTth of the threshold voltage detection transistor Tth in each pixel increases with an increase of the amount of voltage drop of the feeders.

Note that in the actual design, the capacitance of the CgsTth can be controlled e.g., by adjusting the channel width of the threshold voltage detection transistor Tth for each pixel. This is because the parasitic capacitance of a TFT is proportional to the overlapping area of the source or drain with the gate, and therefore the parasitic capacitance is proportional to the overlapping distance in the channel width direction if the overlapping distance in the channel length direction is the same. Note that this kind of method has an advantage of suppressing changes of manufacturing processes, and enabling productivity to be maintained at high levels.

EXAMPLE

Figure 9:
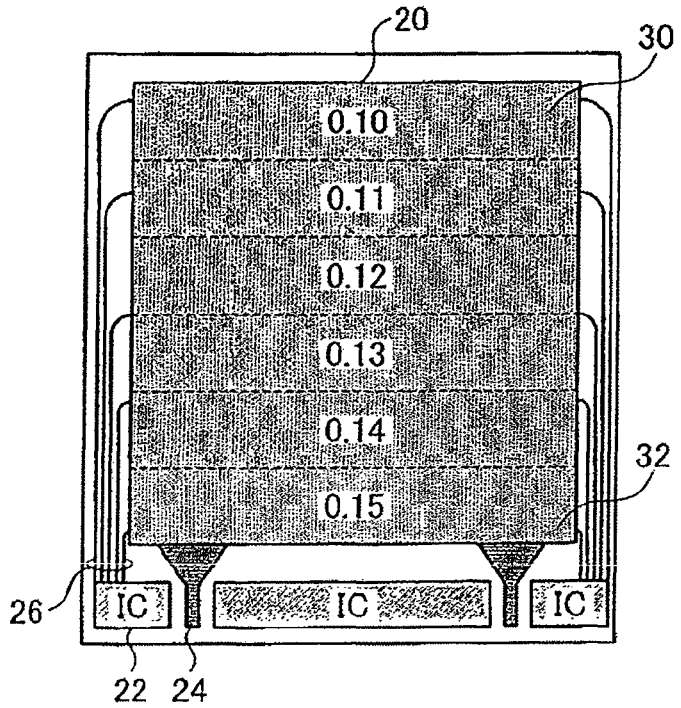
FIG. 9 shows one example of an image display device that is designed such that a gate-source capacitance CgsTth of a threshold voltage detection transistor Tth can vary depending on the distance from the input center.

FIG. 9 shows one example of an image display device that is designed such that the gate-source capacitance CgsTth of a threshold voltage detection transistor Tth is adjusted depending on the distance from the input center. In FIG. 9, numerical values identified by hatching on the display screen indicate capacitance ratio (CgsTth/Call) of the gate-source capacitance (CgsTth) of the threshold voltage detection transistor Tth with respect to total capacitance (Call) during the threshold voltage detection transistor Tth being in the on-state. Note that in the example shown in FIG. 9, such a capacitance ratio is set to "0.10" in an upper region 30 of the display screen, and to "0.15" in a lower region 32 of the display screen. However, it should be understood that this is only illustrative and the capacitance ratio is not limited to these numerical values. In the example shown in FIG. 9, the same capacitance ratio is set for each pixel group in which several rows of pixels in a row direction (a direction in parallel to the power supply line) of the display screen are grouped. However, capacitance ratios that differ by the row of pixels may be set. In this way, uniformity in luminance over the entire display screen increases, thereby obtaining better visibility.

(Second Compensation Method—Method of Adjusting Storage Capacitor Cs)

While the gate-source capacitance CgsTth of the threshold voltage detection transistor Tth is adjusted in the first compensation method, the storage capacitor Cs may be adjusted.

For example, like the case of the gate-source capacitance CgsTth of the threshold voltage detection transistor Tth, control may be performed such that the capacitance of the storage capacitor Cs set for each pixel decreases as the distance to the input center increases, that is, as the amount of voltage drop of the feeders increases. Now assuming that the capacitance of the storage capacitor Cs of a pixel circuit nearest to the input center is Csmax, and the variation of the capacitance of the storage capacitor Cs determined based on ΔVgs of the above equation (9) is ΔCs the storage capacitor Cs set for each pixel can be expressed by the following equation, like the foregoing equation (10).

$$Cs=Cs\max-\Delta Cs \quad (15)$$

On the other hand, assuming that a write voltage with the maximum luminance is Vdatamax, the gate-to-source voltage Vgs of the driving transistor Td can be expressed by the following equation by using this Vdatamax.

$$Vgs=Vth+\mathrm{Coled}/(Cs\max-\Delta Cs+\mathrm{Coled})\cdot V\mathrm{datamax} \quad (16)$$

Here, the component of the second term of the above equation (16) corresponds to the variation ΔVgs of an applied voltage to the driving transistor Td, and therefore this ΔVgs can be expressed as follows.

$$\Delta Vgs=\mathrm{Coled}\cdot[1/(Cs\max-\Delta Cs+\mathrm{Coled})-1/(Cs\max+\mathrm{Coled})]\cdot V\mathrm{datamax}=\mathrm{Coled}\cdot\Delta Cs\cdot V\mathrm{datamax}/(Cs\max-\Delta Cs+\mathrm{Coled})\cdot(Cs\max+\mathrm{Coled}) \quad (17)$$

Note that a relationship of ΔCs<<Coled generally holds in the foregoing pixel circuit, and therefore the equation (16) can be further approximated as expressed by the following equation.

$$\Delta Vgs=\mathrm{Coled}\cdot\Delta Cs\cdot V\mathrm{datamax}/(Cs\max+\mathrm{Coled})^2 \quad (18)$$

As a result, the storage capacitor Cs set for each pixel can be expressed, based on both the above equations (15) and (18), by the following equation.

$$Cs=Cs\max-\Delta Vgs\cdot(Cs\max+\mathrm{Coled})^2/(\mathrm{Coled}\cdot V\mathrm{datamax}) \quad (19)$$

Accordingly, by setting the storage capacitor Cs to a capacitance satisfying the equation (19) for each pixel, the variation of the gate-to-source voltage Vgs of the driving transistor Td in each pixel is reduced, thereby obtaining approximately uniform luminance over the entire display screen.

In the case of setting the storage capacitor Cs so as to satisfy the equation (19), when the driving transistor Td and the threshold voltage detection transistor Tth are transistors of the same conductive type, the capacitance of the storage capacitor Cs in each pixel decreases as the amount of voltage drop of the feeders increases.

On the other hand, when the driving transistor Td and the threshold voltage detection transistor Tth are transistors of different conductive types from each other, the capacitance of the storage capacitor Cs in each pixel increases as the amount of the voltage drop of the feeders increases.

(Third Compensation Method—Method of Adjusting Control Voltage of Tth Control Line to Control Threshold Voltage Detection Transistor Tth)

Instead of the foregoing methods, the control voltage of the Tth control line to control the threshold voltage detection transistor Tth may be adjusted.

For example, assuming that in a pixel circuit of each pixel, the maximum value of a voltage (VgH) on the high voltage side applied to the threshold voltage detection transistor Tth is VgHmax, and its variation is ΔVgH, a relationship of the following equation is held between these factors.

$$VgH=VgH\max-\Delta VGH \tag{20}$$

Here, when VgH given by the equation (20) is substituted in the expression (11), the variation ΔVgs of a voltage applied to the driving transistor Td can be expressed as follows.

$$\Delta Vgs=-(VgH\max-\Delta VgH-VgL)\cdot CgsTth/(Cs+CgdTd+CgsTd+CgsTth)=-(VgH\max-VgL)\cdot CgsTth/(Cs+CgdTd+CgsTd+CgsTth)+\Delta VgH\cdot CgsTth/(Cs+CgdTd+CgsTd+CgsTth) \tag{21}$$

When ΔVgH is calculated such that ΔVgs=0 in the above equation (21), ΔVgH can be expressed by the following equation.

$$\Delta VgH=\Delta Vgs\cdot(Cs+CgdTd+CgsTd+CgsTth)/CgsTth \tag{22}$$

Accordingly, when a control voltage reduced only by ΔVgH satisfying the equation (22) from a control voltage (high voltage value), which is applied to the threshold voltage detection transistor Tth in a pixel circuit nearest to the input center, is applied to the threshold voltage detection transistor Tth, the variation of the gate-to-source voltage Vgs of the driving transistor Td in each pixel is reduced, thereby obtaining approximately uniform luminance over the entire display screen.

In the case of changing the control voltage so as to satisfy the equation (22), when the driving transistor Td and the threshold voltage detection transistor Tth are transistors of the same conductive type, the variation ΔVgH of the control voltage in each pixel decreases as the amount of voltage drop of the feeders increases.

On the other hand, when the driving transistor Td and the threshold voltage detection transistor Tth are transistors of different conductive types from each other, the variation ΔVgH of the control voltage in each pixel increases as the amount of the voltage drop of the feeders increases.

(Fourth Compensation Method—Method of Adding an Additional Capacitor)

Figure 12:
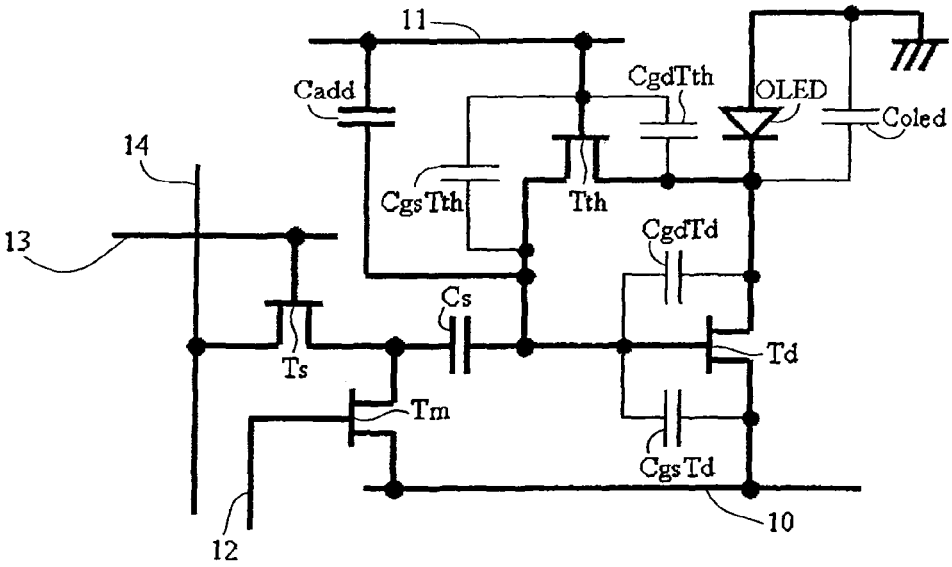
FIG. 12 is a diagram for illustrating still another embodiment of the image display device according to the invention.

Instead of the foregoing methods, for example, an additional capacitor Cadd may be added in parallel to the gate-source capacitance CgsTth of the threshold voltage detection transistor Tth as shown in FIG. 12. Note that the added capacitance in this time is added to the gate-source capacitance CgsTth of the threshold voltage detection transistor Tth as given in the equation (8). Therefore, with an additional capacitor added to a pixel circuit nearest to the input center as a basis, the additional capacitor Cadd having a capacitance reduced by a predetermined amount depending on the distance from the input center, that is, depending on the amount of the voltage drop of the feeders may be added.

In this case, when the driving transistor Td and the threshold voltage detection transistor Tth are of the same conductive type, the capacitance of the additional capacitor Cadd is decreased as the amount of the voltage drop of the feeders increases. When the driving transistor Td and the threshold voltage detection transistor Tth are of different conductive types, the capacitance of the additional capacitor Cadd increases as the amount of the voltage drop if the feeders increases.

(Another Embodiment—Circuit Example with Vth Compensation Function)

Figure 10:
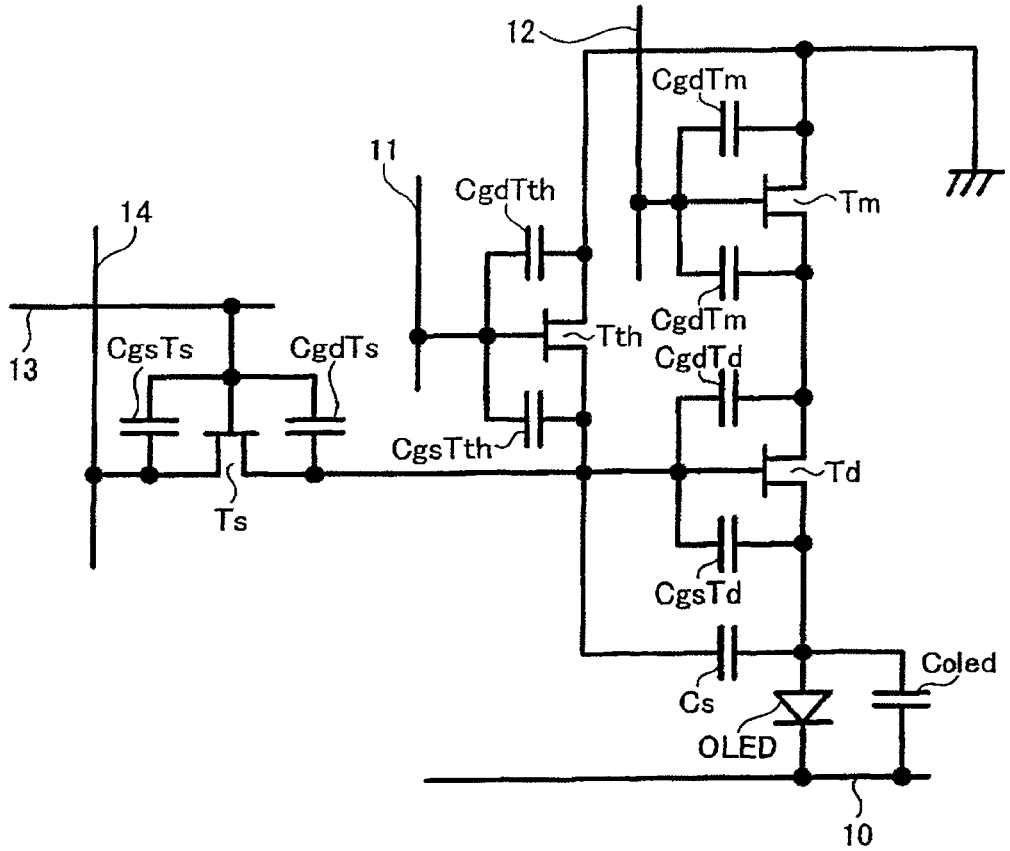
FIG. 10 is a diagram for illustrating an embodiment of the image display device according to the invention.

FIG. 10 is a diagram for illustrating another embodiment that is different from the image display device of FIG. 2, and shows a circuit example having a Vth compensation function. In a pixel circuit shown in FIG. 10, the organic light-emitting element OLED is connected to the low voltage side, and the switching transistor Tm connected to merge line 12 and the driving transistor Td are disposed to be connected in series.

In this kind of pixel circuit, the principle for reducing the variation of the gate-to-source voltage Vgs of the driving transistor Td in each pixel circuit is the same as the aforementioned first to fourth compensation methods. The foregoing first to fourth compensation methods can be applied without any change.

(Another Embodiment—Circuit Example without Vth Compensation Function

Figure 11:
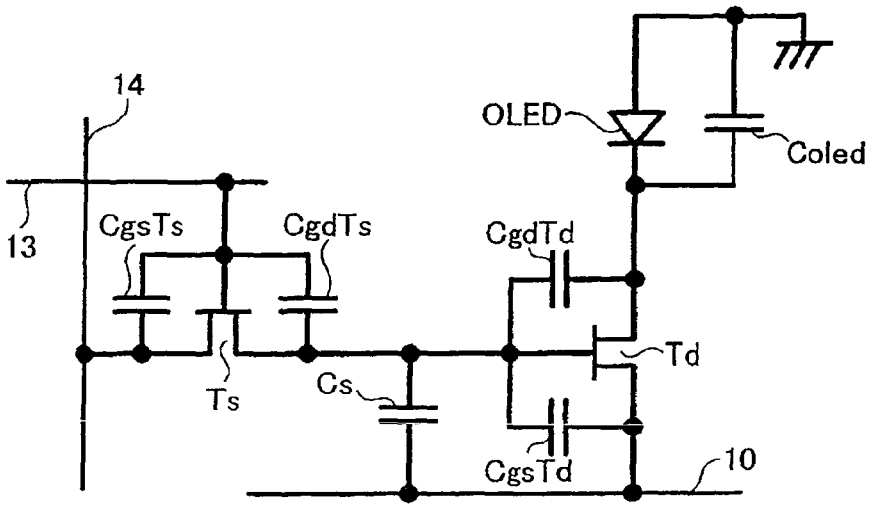
FIG. 11 is a diagram for illustrating another embodiment of the image display device according to the invention.

FIG. 11 is a diagram for illustrating another embodiment that is different from the image display devices of FIGS. 2 and 10, and shows a circuit example not having the Vth compensation function. Because of not having the Vth compensation function, a pixel circuit shown in FIG. 11 does not include components such as the threshold voltage detection transistor Tth, the switching transistor Tm, the Tth control line and the merge line.

In the pixel circuit shown in FIG. 11, the principle for reducing the variation of gate-to-source voltage Vgs of the driving transistor Td in each pixel circuit is the same as in the foregoing pixel circuit having the Vth compensation function. Accordingly, with a change of the control target from the threshold voltage detection transistor Tth to the switching transistor Ts, the aforementioned first to fourth compensation methods can be applied.

For example, in the pixel circuit shown in FIG. 11, if the first compensation method is applied, a gate-drain capacitance (CgdTs) of the switching transistor Ts may be adjusted. By applying the second compensation method, the capacitance of the storage capacitor Cs may be changed. By applying the third compensation method, the control voltage of the scan control line 13 to control the switching transistor Ts may be made variable. By applying the fourth compensation method, an additional capacitor may be added parallel to the gate-drain capacitance CgdTs of the switching transistor Ts.

Note that if an image display device performs a multicolor display where e.g., three primary color pixels of red, green and blue constitute one picture element, or a similar multicolor display, the capacitance ratio of the gate-source capacitance (CgsTth) of the threshold voltage detection transistor Tth to the total capacitance (Call) when the threshold voltage detection transistor Tth is in the on-state generally differs from one color to another. Therefore, by setting a preferable capacitance ratio for each color, for each color, luminance compensation that suppresses the effect of luminance non-uniformity due to the difference in length and resistance of the feeders can be achieved. It will be appreciated that the present invention can be applied to light-emitting elements other than organic light-emitting elements, such as inorganic ELs, as a light-emitting portion.

A feeder system of supplying a power supply voltage from the lower side is employed in the foregoing embodiments. However, a system of supplying a power supply voltage from the upper side or a system of supplying a power supply voltage from both the upper and the lower sides may be employed. In any of these systems, basically, pixels are divided into groups depending on the amount of the voltage drop of the feeders, and at least one of the parasitic capacitance of a transistor, the capacitance of a capacitance element and the voltage of a control line may be adjusted.

Note that herein a "control line" including the "Tth control line 11" and the "scan control line 13" is electrically connected to each pixel. Accordingly, the "threshold voltage detection transistor Tth" and the "switching transistor Ts" are included in a switching portion electrically connected to each control line.

While the invention has been shown and described in detail, the foregoing description is in all aspects illustrative and not restrictive. It is therefore understood that numerous modifications and variations can be devised without departing from the scope of the invention.

What is claimed is:

1. An image display device comprising:

a plurality of pixels; and a feeder that commonly supplies power to said plurality of pixels, each of said pixels including:

a light-emitting portion that emits light by a current being supplied to said light-emitting portion;

a driver that controls light emission of said light-emitting portion;

a switching portion electrically connected to said driver, wherein a parasitic capacitance of said switching portion is determined with respect to each one pixel or one group of pixels according to a voltage drop of said feeder; and a second switching portion electrically connected to said driver and said switching portion, wherein said driver has a first terminal, a second terminal, and a third terminal, said first terminal controlling the current flowing between said second terminal and said third terminal, said switching portion has a fourth terminal, a fifth terminal, and a sixth terminal, said fourth terminal controlling the current flowing between said fifth terminal and said sixth terminal, and wherein said second terminal is directly connected to said light-emitting portion during light emission of said light-emitting portion, said fifth terminal is directly connected to said second terminal, and said sixth terminal is directly connected to said first terminal, and said control line is electrically connected to said fourth terminal.

2. An image display device comprising:

a plurality of pixels; and a feeder that commonly supplies power to said plurality of pixels, each of said pixels including:

a light-emitting portion that emits light by a current being supplied to said light-emitting portion;

a driver that controls light emission of said light-emitting portion;

a capacitance element electrically connected to said driver, wherein a capacitance of said capacitance element is determined with respect to each one pixel or one group of pixels according to a voltage drop of said feeder;

a switching portion electrically connected to said driver; and a second switching portion electrically connected to said driver and said switching portion, wherein said driver has a first terminal, a second terminal, and a third terminal, said first terminal controlling the current flowing between said second terminal and said third terminal, said switching portion has a fourth terminal, a fifth terminal, and a sixth terminal, said fourth terminal controlling the current flowing between said fifth terminal and said sixth terminal, and wherein said second terminal is directly connected to said light-emitting portion during light emission of said light-emitting portion, said fifth terminal is directly connected to said second terminal, and said sixth terminal is directly connected to said first terminal, and said control line is electrically connected to said fourth terminal.

3. An image display device comprising:

a plurality of pixels;

a feeder that commonly supplies power to said plurality of pixels;

a control line electrically connected to each of said pixels; and a drive circuit portion that sets a voltage with respect to each one pixel or one group of pixels of said control line according to a voltage drop of said feeder, each of said pixels including:

a light-emitting portion that emits light by a current being supplied to said light-emitting portion;

a driver that controls light emission of said light-emitting portion;

a switching portion electrically connected to said control line; and a second switching portion electrically connected to said driver and said switching portion, wherein said driver has a first terminal, a second terminal, and a third terminal, said first terminal controlling the current flowing between said second terminal and said third terminal, said switching portion has a fourth terminal, a fifth terminal, and a sixth terminal, said fourth terminal controlling the current flowing between said fifth terminal and said sixth terminal, and wherein said second terminal is directly connected to said light-emitting portion during light emission of said light-emitting portion, said fifth terminal is directly connected to said second terminal, and said sixth terminal is directly connected to said first terminal, and said control line is electrically connected to said fourth terminal.

4. The image display device according to claim 2, wherein said capacitance element temporarily holds an image data voltage.

5. The image display device according to claim 3, further comprising a capacitance element that is electrically connected to said driver, and that temporarily holds an image data voltage applied to said driver, wherein said switching portion is electrically connected to said capacitance element and controls a timing for supplying said image data voltage to said capacitance element.

6. The image display device according to claim 1, wherein said plurality of pixels are arranged in a matrix, the image display device further comprising a power supply line commonly connected to each one of said light emitting portion in the plurality of pixels arranged in a row direction, and wherein said feeder is disposed along a direction approximately orthogonal to said power supply line and is electrically connected to said power supply line at a point crossing said power supply line.

7. The image display device according to claim 6, wherein the plurality of said pixels are grouped as a pixel group according to the voltage drop of said feeder, and the parasitic capacitance of said switching portion differs from one said pixel group to another.

8. The image display device according to claim 2, wherein said plurality of pixels are arranged in a matrix, the image display device further comprising a power supply line commonly connected to each one of said light emitting portion in the plurality of pixels arranged in a row direction, and wherein said feeder is disposed along a direction approximately orthogonal to said power supply line and is electrically connected to said power supply line at a point crossing said power supply line.

9. The image display device according to claim 8, wherein the plurality of said pixels are grouped as a pixel group according to the voltage drop of said feeder, and the capacitance of said capacitance element differs from one said pixel group to another.

10. The image display device according to claim 3, wherein said plurality of pixels are arranged in a matrix, the image display device further comprising a power supply line commonly connected to each one of said light emitting portion in the plurality of pixels arranged in a row direction, and wherein said feeder is disposed along a direction approximately orthogonal to said power supply line and is electrically connected to said power supply line at a point crossing said power supply line.

11. An image display device comprising:

a plurality of pixels;

a feeder that commonly supplies power to said plurality of pixels; and a control line electrically connected to each of said pixels, each of said pixels including:

a light-emitting portion that emits light by a current being supplied to said light-emitting portion;

a driver that has a first terminal, a second terminal, and a third terminal, said first terminal controlling a current flowing between said second terminal and said third terminal, and that controls light emission of said light-emitting portion;

a switching portion that has a fourth terminal, a fifth terminal, and a sixth terminal, said fourth terminal controlling a current flowing between said fifth terminal and said sixth terminal, and that is electrically connected to said control line; and an additional capacitor electrically connected to said fourth terminal and said sixth terminal, wherein:

said second terminal is directly connected to said light-emitting portion during light emission of said light-emitting portion;

said fifth terminal is directly connected to said second terminal;

said sixth terminal is directly connected to said first terminal;

said control line is electrically connected to said fourth terminal; and a capacitance of said additional capacitor differs from each one pixel or one group of pixels depending on an amount of voltage drop of said feeder.

* * * * *